US010280587B2

(12) United States Patent
Nachyla

(10) Patent No.: US 10,280,587 B2
(45) Date of Patent: May 7, 2019

(54) METHOD OF MONITORING ACCESS COVERS OF UNDERGROUND INFRASTRUCTURE

(71) Applicant: Dariusz Nachyla, Bielawa (PL)

(72) Inventor: Dariusz Nachyla, Bielawa (PL)

( * ) Notice: Subject to any disclaimer, the term of this patent is extended or adjusted under 35 U.S.C. 154(b) by 0 days.

(21) Appl. No.: 15/772,081

(22) PCT Filed: Oct. 30, 2016

(86) PCT No.: PCT/PL2016/000120
§ 371 (c)(1),
(2) Date: Apr. 29, 2018

(87) PCT Pub. No.: WO2017/074205
PCT Pub. Date: May 4, 2017

(65) Prior Publication Data

US 2018/0313054 A1 Nov. 1, 2018

(30) Foreign Application Priority Data

Oct. 31, 2015 (PL) ..... P.414637

(51) Int. Cl.
*E02D 29/14* (2006.01)

(52) U.S. Cl.
CPC ..... *E02D 29/1481* (2013.01); *E02D 29/1427* (2013.01)

(58) Field of Classification Search
CPC ..... E02D 29/1481
USPC ..... 404/25
See application file for complete search history.

(56) References Cited

U.S. PATENT DOCUMENTS 7,002,481 B1 * 2/2006 Crane ..... G08B 25/08 324/207.2
7,402,790 B2 * 7/2008 Browning, Jr. ..... G02B 6/4469 250/221
7,852,213 B2 * 12/2010 Browning, Jr. ..... G08B 13/186 250/227.14

(Continued)

FOREIGN PATENT DOCUMENTS

WO 2007146972 12/2007

OTHER PUBLICATIONS

WO2017074205 International Search Report, Written Opinion.

*Primary Examiner* — Gary S Hartmann
(74) *Attorney, Agent, or Firm* — Soody Tronson; STLG

(57) ABSTRACT

An access cover to underground city infrastructure, particularly a cast iron or a cast iron-concrete cover provided with a cover detection sensor connected with a radio frequency signal transmitting antenna through a transmitter, characterized in that an antenna module (1) provided with a housing made of a material neutral to electromagnetic fields, preferably made of plastic, is installed in the through channel or hole (4) with variable cross-section, and removably fixed at the bottom to a sensor module (2) located underneath the bottom of the cover (3), provided with a battery powered, low current electronic system containing a radio transmitter and an acceleration sensor or a gyroscope and an appropriate controller which detects changes to the position of cover (3) in space and in time, whereby the surface area of the sensor module (2) is greater than the surface area of the through channel or hole (4).

8 Claims, 3 Drawing Sheets

(56) References Cited

U.S. PATENT DOCUMENTS

| | | | | |
|---|---|---|---|---|
| 7,889,079 | B2 * | 2/2011 | Albahri | G08B 13/149 116/12 |
| 7,956,316 | B2 * | 6/2011 | Browning, Jr. | G08B 13/124 250/221 |
| 8,237,576 | B2 * | 8/2012 | Wander | E02D 29/1427 340/632 |
| 8,674,830 | B2 * | 3/2014 | Lanham | E02D 29/14 340/540 |
| 9,127,431 | B2 | 9/2015 | Anham | |
| 2010/0019912 | A1 | 1/2010 | Wander | |
| 2018/0163361 | A1 * | 6/2018 | Nunnery | E02D 29/14 |

* cited by examiner

METHOD OF MONITORING ACCESS COVERS OF UNDERGROUND INFRASTRUCTURE

TECHNICAL FIELD

The invention relates to a method of monitoring access covers of underground infrastructure, particularly cast iron or cast iron-concrete covers and a cover made according to said method.

BACKGROUND

U.S. Pat. No. 9,127,431 discloses a safe cover of an inspection chamber containing an at least partial coating made of non-metallic material conducting radio signals. This coating is installed on the framework of the manhole, such that it covers the inspection chamber opening. The cover is provided with a sabotage sensor detecting changes of its location, and with a transmitter. The transmitter is configured to generate a radio frequency signal if the sensor detects the pre-set motion of the manhole cover coating. A mobile connection is provided between an antenna and the transmitter, allowing radio frequency energy to be generated by the manhole cover coating and sent to a receiver located outside the manhole.

DETAILED DESCRIPTION

Figure 1:
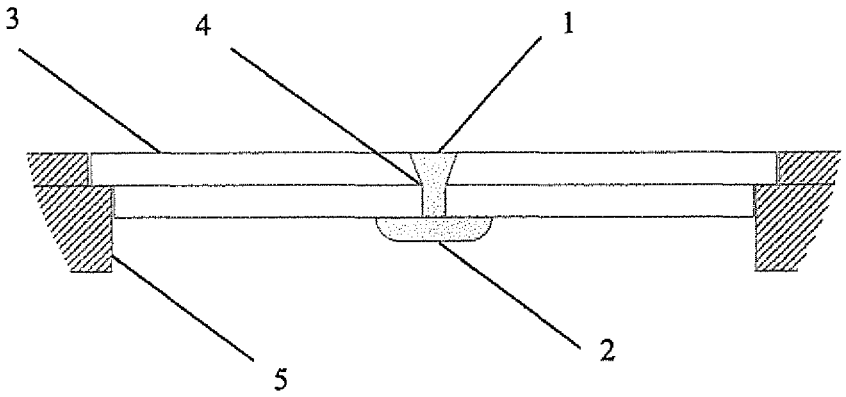
FIG. 1 shows a cover with a sensor module installed below a hole in vertical cross-section.

An access cover to underground city infrastructure, particularly a cast iron or a cast iron-concrete cover provided with a cover opening sensor connected with an antenna emitting radio frequency signal via a transmitter according to the invention is characterised in that a vertical through channel or hole with a variable cross-section is provided in the cover, in which an antenna module is installed, provided with a cover made of a material neutral to electromagnetic field, preferably made of a plastic material. The antenna module is removably fixed at the bottom to a sensor module located below the through channel (or hole) or in a compartment formed in the bottom part of the through channel or hole. The sensor module is provided with a low current, battery powered electronic system containing a radio transmitter and an acceleration sensor or a gyroscope and an appropriate controller, detecting changes in position of the cover in space and time, whereby the surface area of the sensor module is greater than the cross-section area of the through channel (or a hole).

Preferably, the top part of the antenna module housing is covered with a layer of composite material with high stretching resistance or of non-metallic material resistant to high temperatures.

The antenna module is preferably connected to the sensor module by screwing the modules together, joining with screws or by a clip-type connection.

A method of monitoring access covers to underground city infrastructure, particularly of cast iron or cast iron-concrete covers including recording of changes to cover position over space and time according to the invention is characterised in that a cover according to the invention is used as the access cover.

The channel or hole provided in the cover allows signal to be transmitted by the antenna, as transmission through the bulky cover is generally impossible, unless high power is used, which would in turn contradict the idea of using a low current system. The design according to the invention practically prevents the antenna module from being pushed inside the cover or otherwise rendered inoperational.

The electronic system and the software used in the cover according to the invention allow efficient detection of cover opening and allow such a detection to be distinguished from other, physically similar operations, i.e. it prevents the risk of sending false alarms related to cover opening. The mechanical-electronic design allows information related to detection of cover opening to be sent wirelessly to the cover owner, regardless of potential attempts to disrupt such communication. The two-part, modular element monitoring covers according to the invention, responsible for detection of cover opening and wireless transmission of signal related to such opening prevents unauthorised individuals from shutting it down or destroying it before such information related to cover opening reaches the cover owner. A cover according to the invention is resistant to mechanical damage and does not require an external power source, is reliably detecting event attempts at cover opening, and each information related to such detections is immediately sent to the cover owner before devices located underneath potentially destroyed by an unauthorized individual.

Figure 2:
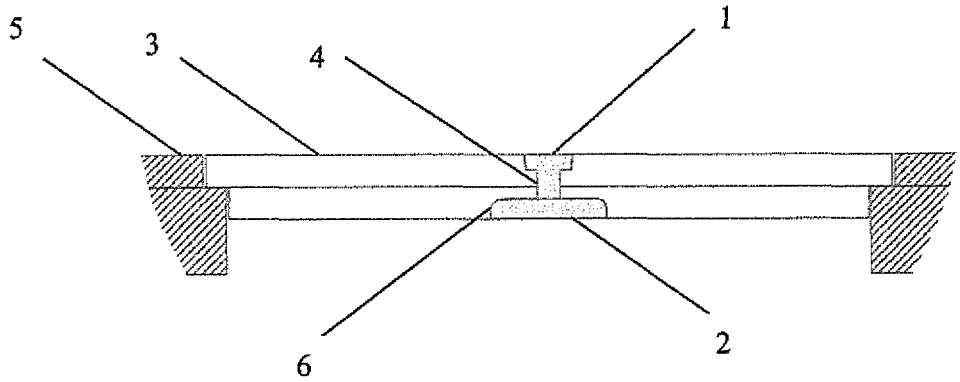
FIG. 2 is a schematic representation of a cover with a sensor module installed inside a hole of the cover in vertical cross-section.

The invention is presented in more detail as embodiments presented in the drawing, in which FIG. 1 presents schematically a cover with a sensor module installed below the through channel or hole in vertical cross-section, and FIG. 2 presents schematically a cover with a sensor module installed inside the through channel or a hole in vertical cross-section.

Example I

As FIG. 1 shows, cover 3 of a cast iron or a cast iron-concrete manhole is placed on body 5. A small through channel (or hole) 4 is provided in the central part of cover 3, with an inverted frustoconical cross-section changing to a cylindrical cross-section. Antenna module 1 is placed inside channel (or hole) 4, with sensor module 2 attached to the antenna module 1 on the bottom side 3 of the cover. The surface area of sensor module 2 is larger than the area of channel (or hole) 4 cross-section. An antenna enabling communication, i.e. wireless transmission of alarm messages, is provided in the antenna module 1, the housing of which is made of a plastic practically neutral to electromagnetic field. The design of antenna module 1 is resistant to attempts of mechanical damage thanks to its shape, i.e. thanks to its small surface area and lack of practical possibility of pushing it inside or removing it because of its screwed connection with sensor module 2. Hole 4 provided in the cover allows signal to be transmitted by the antenna. A low current, energy-saving electronic system with a battery powered radio transmitter is provided in the sensor module 2. The electronic system includes an acceleration sensor or a gyroscope. An appropriate controller detects cover motions characteristic for cover opening, i.e. changes to the inclination angle or general position changes in space and in time. Duration of analysed phenomena is very important, as sensor module 2, under real operational conditions of the manhole cover, may generally very often detect accelerations and changes to the inclination angle caused by vibrations in the environment, or by stepping or driving over the cover 3, especially if the cover is not installed stably enough. A dedicated algorithm allows systems indicating cover 3 being lifted to be effectively identified among many signals transmitted by the sensor module 2. Sensor module 2 uses energy saving electronic components, in particular the radio transmitter, which allows many years of uninterrupted operation of the entire system using a battery as a power source, without the need to replace the battery.

Example II

Cover 3 is made as in Example I, with the exception that the top housing part of the antenna module 1 is covered with a composite material with high resistance to stretching, of kevlar type, or of a non-metallic material resistant to high temperatures.

Example III

Figure 3:
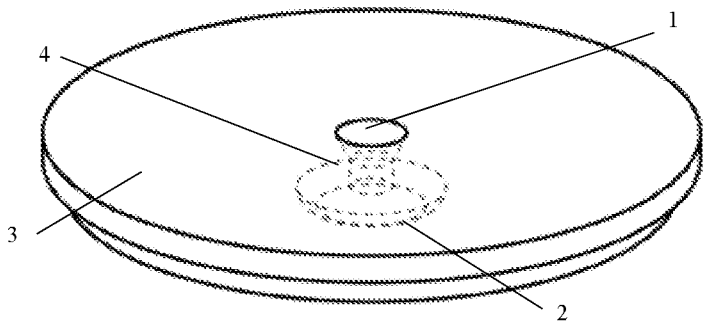
FIG. 3 is a perspective view of a cover with a sensor module installed inside a hole of the cover.
Figure 4:
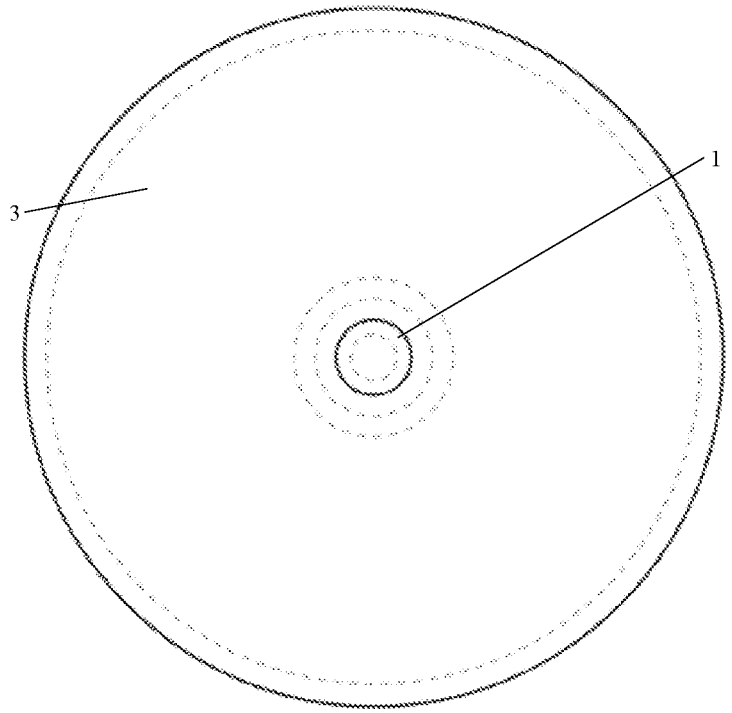
FIG. 4 is a top view of a cover with a sensor module installed inside a hole of the cover.
Figure 5:
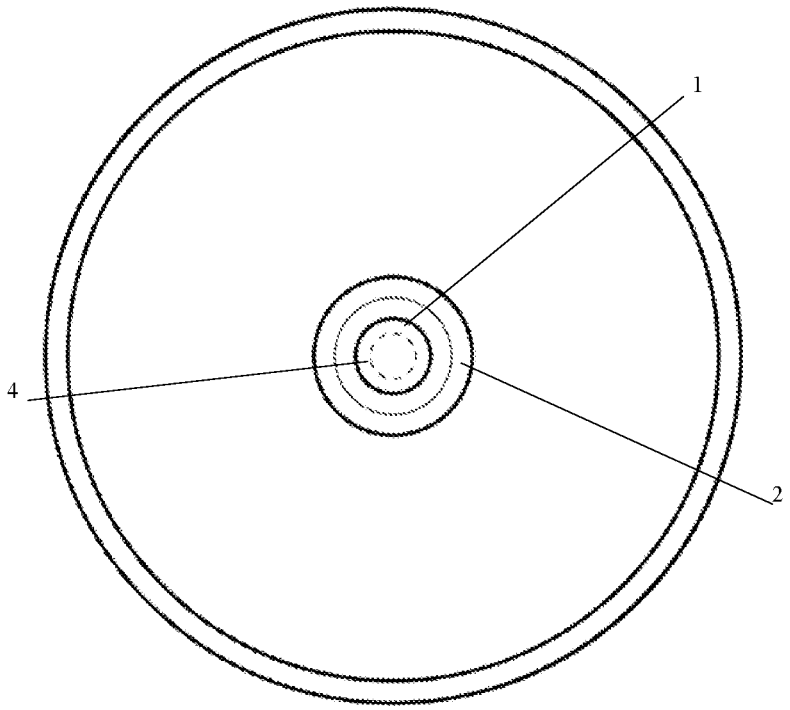
FIG. 5 is a bottom view of a cover with a sensor module installed inside a hole of the cover.

As FIG. 2 shows, cover 3 is made as in Example I, with the exception that sensor module 2 is installed inside cover 3, in a compartment 6 formed in the bottom part of the through channel (or hole) 4. FIG. 3 is a perspective view of a cover with a sensor module installed inside all of the cover. FIG. 4 is a top view of a cover with a sensor module installed inside a hole of the cover. FIG. 5 is a bottom view of a cover with a sensor module installed inside all of the cover.

Example IV

Sensor module 2 allows detection and processing of changes of position of the cover 3 executed as in Example I, in Example II or in Example I in space and in time, subsequently antenna provided in the antenna module 1 wirelessly sends a signal characteristic for opening of cover 3 to a receiver of the cover owner.

The invention claimed is:

1. An access cover for accessing underground city infrastructure, comprising:

a cover formed from cast iron or cast iron concrete and having top and bottom surfaces;

a hole having a variable cross-section and formed within the cover;

a sensor module having a largest cross section greater than a smallest cross-section of the hole and disposed adjacent the cover bottom surface and having a low current, battery powered electronic system including a radio transmitter, a controller, and a sensor formed from an acceleration sensor or a gyroscope, for detecting temporal and spatial changes to cover position; and an antenna module disposed in an antenna housing formed from electromagnetic-neutral material and disposed within the hole and removably affixed to the sensor module for receiving radio frequency signal via the sensor module transmitter.

2. The cover of claim 1, wherein the sensor is disposed in a compartment formed in the hole.

3. The cover of claim 1, wherein the sensor is disposed underneath the cover bottom surface.

4. The cover of claim 1, wherein a top surface of the antenna housing facing the cover top surface comprises a top layer of material resistant to chemical, thermal, and mechanical influences.

5. The cover of claim 4, wherein resistant material comprises high temperature resistant non-metallic material.

6. The cover of claim 1, wherein the antenna module is removably affixed to the sensor module by screws or clip-type connections.

7. A method for monitoring access covers for accessing underground city infrastructure, comprising:

providing an access cover for accessing underground city infrastructure, the access cover comprising:

a cover formed from cast iron or cast iron concrete and having top and bottom surfaces;

a hole having a variable cross-section and formed within the cover;

a sensor module having a largest cross section greater than a smallest cross-section of the hole and disposed adjacent the cover bottom surface and having a low current, battery powered electronic system including a radio transmitter, a controller, and a sensor formed from an acceleration sensor or a gyroscope, for detecting temporal and spatial changes to cover position; and an antenna module disposed in an antenna housing formed from electromagnetic-neutral material and disposed within the a hole and removably affixed to the sensor module for receiving radio frequency signal via the sensor module transmitter; and transmitting temporal and spatial changes to position of the cover to a receiver.

8. The method of claim 7, wherein the transmitting of temporal and spatial changes is effectively instantaneous.

* * * * *